United States Patent [19]

Nakano et al.

[11] Patent Number: 4,794,218

[45] Date of Patent: Dec. 27, 1988

[54] DOOR ASSEMBLY FOR MICROWAVE HEATING APPARATUS

[75] Inventors: Okihiko Nakano, Nara; Yohzoh Ishimura, Kashihara, both of Japan

[73] Assignee: Matsushita Electric Industrial Co. Ltd., Osaka, Japan

[21] Appl. No.: 143,026

[22] Filed: Jan. 12, 1988

Related U.S. Application Data

[63] Continuation of Ser. No. 799,737, Nov. 19, 1985, Pat. No. 4,742,201.

[30] Foreign Application Priority Data

Nov. 20, 1984 [JP] Japan ..... 59-244966
Nov. 20, 1984 [JP] Japan ..... 59-244967
Jan. 14, 1985 [JP] Japan ..... 60-4278

[51] Int. Cl.[4] ..... H05B 6/76
[52] U.S. Cl. ..... 219/10.55 D; 174/35 GC
[58] Field of Search ..... 219/10.55 D, 10.55 R; 174/35 GC, 35 MS

[56] References Cited

U.S. PATENT DOCUMENTS 4,471,194 9/1984 Hosokawa et al. ..... 219/10.55 D
4,559,428 12/1985 Takeuji ..... 219/10.55 D
4,584,447 4/1986 Kusunoki et al. ..... 219/10.55 D

FOREIGN PATENT DOCUMENTS 53-88246 8/1978 Japan ..... 219/10.55 D

*Primary Examiner*—Philip H. Leung
*Attorney, Agent, or Firm*—Wenderoth, Lind & Ponack

[57] ABSTRACT

A high frequency heating apparatus has an oven-defining structure having an access opening in communication with a heating chamber defined therein, and a hingedly supported metallic door for selectively opening and closing over the access opening. The door has its peripheral area formed with a groove open towards the heating chamber. The bottom of the groove is situated frontwardly of the door with respect to the apparatus. An outerside wall extending from the groove is formed with a plurality of cutouts and a plurality of generally rectangular openings alternating with the cutouts. Each of the cutouts and each of the rectangular openings have one edge positioned on one side of a setup portion, protruding from the bottom of the groove, adjacent the oven-defining structure. The outer wall has a portion bent to protrude transversely into the groove to define a partitioning wall.

1 Claim, 3 Drawing Sheets

DOOR ASSEMBLY FOR MICROWAVE HEATING APPARATUS

This application is a continuation of Ser. No. 799,737, filed on Nov. 19, 1985, U.S. Pat. No. 4,742,201.

BACKGROUND OF THE INVENTION

1. Field of the Invention

The present invention generally relates to a microwave heating apparatus and, more particularly, to a door assembly used in the microwave heating apparatus.

2. Description of Related Art

Nowadays, the microwave heating apparatus or oven is widely used not only in restaurants and other food industries, but also in homes. In general, the microwave oven designed for heating, for example, a food item or items comprises an outer casing which is approximately cubical and opens at that side thereof which forms the front of the microwave oven, a metallic inner casing or oven-defining enclosure which is likewise approximately cubical and has an access opening at one side and which is fixedly accommodated within the outer casing with the access opening generally coincident with, and lying in the same plane as, the open front of the outer casing, and a hingedly supported door assembly for selectively opening and closing the access opening. At the front of the microwave oven, a front trim panel having a central opening is flanged, or secured in any manner, at its inner and outer peripheral edges to the enclosure and the outer casing, respectively, exteriorly around the access opening with the central opening coincident with the access opening. The door assembly is of such a size as to have its peripheral portion contact the front trim panel around the access opening when it is held in a closed position closing the access opening.

As is well known to those skilled in the art, it is a customary practice to provide the door assembly with a high frequency attenuator for the prevention of leakage of microwaves out of the enclosure. Many types of attenuator are currently utilized, and the most popular one is a choke type. As disclosed in, for example, U.S. Pat. No. 3,182,164, the choke type is characteristically constituted by a choke groove which is defined in a generally rectangular metallic frame of the door assembly so as to have its effective depth equal to one fourth of the wavelength of the microwave used.

On the other hand, the use of the choke groove having its effective depth smaller than one fourth of the wavelength is also well known from, for example, PCT International Publication No. WO84/01083 as shown in FIG. 1 of the accompanying drawings.

Referring to FIG. 1 the door assembly comprises a perforated metal plate 1 having a multiplicity of perforations defined at that portion thereof which coincides with the access opening of the enclosure, and also having a non-perforated peripheral portion bent and shaped to form a generally channel-shaped cross-section defined by an inner wall 1*a* extending outwardly of the enclosure at right angles to the perforated body of the plate 1, an outer wall 1*b* parallel to the inner wall 1*a*, and a front wall 1*c* connecting the inner and outer walls 1*a* and 1*b* together and spaced a predetermined distance from the plane of the perforated body of the plate 1, said walls 1*a*, 1*b* and 1*c* altogether defining a choke cavity or groove 2.

The door assembly shown in FIG. 1 also comprises a generally C-sectioned partition wall member 3 accommodated within the choke groove 2 and having a base 3*a* secured to the front wall 1*c*, a lateral wall 3*b* parallel to the outer wall 1*b* and perpendicular to the base 3*a*, a rear wall 3*c* perpendicular to the lateral wall 3*b* and parallel to and confronting the base 3*a*, and a parting wall 3*d* perpendicular to the rear wall 3*c* and spaced a predetermined distance from the rear wall 3*c* and extending in a direction towards the base 3*a* and parallel to the inner wall 1*a*. The partition wall member 3 has a plurality of equally spaced cutouts 4 each traversing the walls 3*d*, 3*c* and 3*b* and terminating at the joint between the base 3*a* and the lateral wall 3*b*, and also has a plurality of generally rectangular openings 5 defined in the lateral wall 3*b* in alternating relationship with the cutouts 4. In this construction, the rear wall 3*c* of the partition wall member partially closes the opening leading to the choke groove 2 whereas a groove defined between the inner wall 1*a* and the parting wall 3*d* constitutes an inlet line for the introduction of the high frequency electromagnetic waves into the choke groove 2, which groove between the walls 1*a* and 3*d* becomes wider beyond the free edge of the parting wall 3*d* with the impedance characteristic of the inlet line consequently varied.

By optimizing a combination of the narrow and wide grooves referred to above, it is possible to reduce the depth of the choke groove to a value smaller than the quarter wavelength of the high frequency used.

A groove delimited between the partition wall member 3 and the outer wall 1*b* may be referred to as a second choke groove operable to attenuate that component of the microwave power which has leaked from the above described, first choke groove without having been completely attenuated.

The cutouts 4 periodically defined in the partition wall member 3 over the length thereof serve to restrict the propagation of the high frequency electromagnetic waves lengthwise direction of the partition wall member 3.

The structure defining the above described choke groove is advantageous in that, in order to realize the choke groove of a depth equal to one n-th of the wavelength of the high frequency used, the compactness and the lightweight feature can be accomplished by increasing the number n. However, the extent to which the accuracy of the dimensions of the various component parts brings about a change in the characteristic impedance tends to increase with increase of the number n, and therefore, the improvement in accuracy of the dimensions of the various component parts is an extremely important factor for achieving an optimum attenuation of the high frequency energy. More specifically, if the number n is of a great value, a slight change in width of the high frequency inlet line brings about a relatively great change in characteristic impedance with the consequent reduction in the attenuating effect.

While the partition wall member 3 is often secured to the front wall 1*c* by spot welding, the positioning is difficult during the welding and, accordingly, it has long been felt difficult to increase the accuracy in the dimensions associated with the wall member in the choke groove.

Moreover, since the lateral wall 3*b* of the partition wall member 3 is continuous with the base 3*a*, an local areas are left by the cutouts 4 and the rectangular openings 5, the structure as a whole has an insufficient physical strength and is susceptible to bending during the machining and/or transportation, of the wall member accompanied by the detrimental change in the effective width of the choke groove.

In order to compensate for reduction in attenuating power because of the presence of the above discussed problems, numerous methods have been contemplated: to increase the width of the second choke groove, to add a structural element to a portion adjacent the second choke groove to make it complicated in shape, to employ microwave absorbing elements such as ferrite, and so on. However, all of the contemplated methods tend to increase the dimensions as well as the weight of the door assembly, rendering the microwave oven as a whole to be costly.

Furthermore, in order to reduce the size of the choke groove and to simplify the method of the manufacture thereof, Japanese Laid-open Patent Publication No. 59-177893 discloses a choke groove formed by preparing a generally rectangular metal plate having its four side portions slit inwardly so as to leave a plurality of tangs and then bending these tangs inwardly so as to provide the metal plate with a generally G-shaped cross-section. Even in this example, making the choke groove compact results in the reduction of the physical strength of the frame structure for the door assembly as a whole to such an extent that the door assembly may deform or warp during the use thereof and/or the door assembly may fail to tightly contact the front trim panel around the access opening when in the closed position.

SUMMARY OF THE INVENTION

According to the present invention, a door assembly for the high frequency heating apparatus, i.e., the microwave oven, comprises a generally rectangular metal plate having its four-sided peripheral portion bent and shaped to form an inner wall frontwardly protruding generally at right angles to the remaining central portion of the metal plate, and a front wall protruding laterally outwardly from and generally at right angles to the inner wall and spaced a predetermined distance from the plane flush with the central portion of the metal plate. The door assembly also comprises a choke defining structure having a plurality of equally spaced transverse cutouts and a corrresponding number of generally rectangular openings defined therein in a uniformly alternating relationship with the cutouts, said choke defining structure being connected to the front wall so as to define a choke groove between it and the inner wall.

In one preferred embodiment of the present invention, the choke defining structure is constituted by a frame member separate from the metal plate, which frame member has a base, a lateral wall at right angles to the base, a rear wall perpendicular to the lateral wall and parallel to the base, and a partitioning wall perpendicular to and extending from one side of the rear wall opposite to the lateral wall and spaced a predetermined distance from the rear wall while extending towards the base. This choke defining structure, that is, the frame member, is connected to the metal plate with the base rigidly secured by, for example, spot welding to the front wall of the peripheral portion of the metal plate. In this choke defining structure, the rectangular openings are defined in the lateral wall in equally spaced relation to each other, and the cutouts extend from the partitioning wall to the lateral wall through the rear wall and between each neighboring rectangular openings, terminating at a portion of the lateral wall that is spaced a predetermined distance inwardly from the base.

For reinforcement purposes, a free edge portion of the front wall is preferably bent to form a backup rib to avoid any possible deformation of the front wall. The backup rib may be generally corrugated or indented for further reinforcing the front wall and, hence, the door assembly as a whole.

In another preferred embodiment of the present invention, the choke defining structure is integrally formed with the metal plate, in which case no base is needed and the front wall of the metal plate serves as a base.

In a further preferred embodiment of the present invention, a reinforcement is fitted to the door assembly at a position which does not adversely affect the dimensions of the choke.

BRIEF DESCRIPTION OF THE DRAWINGS

The present invention will become clear from the following description taken in conjunction with preferred embodiments thereof with reference to the accompanying drawings, in which.

DETAILED DESCRIPTION OF THE EMBODIMENTS

Figure 2:
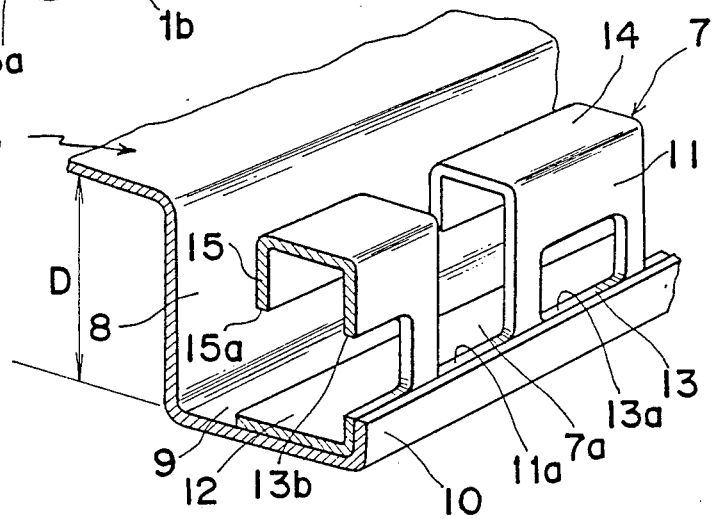
FIG. 2 is a view similar to FIG. 1, showing a door assembly according to a preferred embodiment of the present invention.
Figure 3:
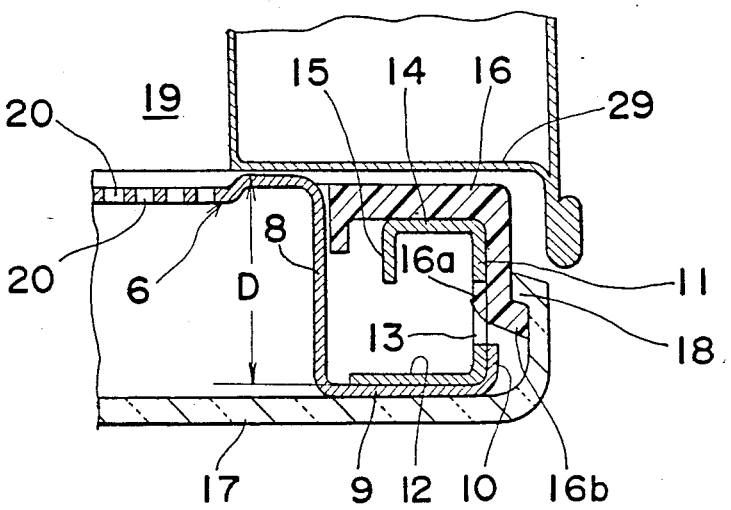
FIG. 3 is a transverse sectional view of a portion of the door assembly shown in FIG. 2.

Referring first to FIGS. 2 and 3, a hingedly supported door assembly for a microwave oven comprises a generally rectangular metal plate 6 having its central area perforated at 20 for permitting an operator of the microwave oven to look into the heating chamber identified by 19, and having its four-sided peripheral area shaped by, for example, a metal forming technique, to form an inner side wall 8 extending perpendicular to the perforated central area of the metal plate and protruding frontwardly from the perforated central area, a front bottom wall 9 protruding laterally outwardly from the inner wall 8 and lying in a plane spaced a predetermined distance from the plane flush with the perforated central area, and an outer side wall 10 protruding a predetermined small distance rearwardly relative to the front wall 9 and extending parallel to the inner wall 8 so as to define a choke groove in cooperation with the inner and front walls 8 and 9, which groove opens towards a front trim panel 29 situated exteriorly around the access opening (shown by 28 in FIG. 8) leading to the heating chamber 19. The metal plate 6 of the above described structure may be prepared from sheet metal by the use of any known press work, for example, a metal forming or drawing technique.

The door assembly also comprises a generally elongated slitted structure 7 having a generally C-shaped cross-section including a base 12, a lateral wall 11 which serves as an outer wall in relation to the front wall 8 with the choke groove defined between them and which protrudes from and at right angles to the base 12, a rear wall 14 protruding from and at right angles to the lateral wall 11 and confronting the base 12, and a partition wall 15 protruding from and at right angles to the rear wall 14 and extending in a direction towards the base 12 with its free side edge 15*a* terminating at a position spaced inwardly from the base 12. The slitted structure 7 is fixedly mounted on the metal plate 6 with the base 12 flat against and rigidly secured to the front wall 9, and has a plurality of transverse cutouts 7*a* defined therein which are equally spaced apart relative to each other. Each of these cutouts 7*a* extends inwardly from the free side edge 15*a* of the partition wall 15 to the lateral wall 11 through the rear wall 14 and terminates at a predetermined distance from the joint between the base 12 and the lateral wall 11 leaving a trimmed edge 11*a* which is generally flush with a free edge of the outer wall 10 remote from the front bottom wall 9. Between the cutouts 7*a* are defined projections extending from the front wall 9, each comprised of the lateral wall 11, rear wall 14, and partition wall 15.

The slitted structure 7 also has a plurality of generally rectangular openings 13 defined in the lateral wall 11 which are equally spaced relative to each other and alternate with the cutouts 7*a*, each of said rectangular openings 13 being positioned so that one of the four sides of the shape of the respective opening 13 which is closest to the base 12 as shown by 13*a* is generally flush with the free edge of the outer wall 10 and is also in line with the trimmed edge 11*a*. The four-sided lip region left in the lateral wall 11 by the formation of each rectangular opening 13 has its four corners rounded slightly, and similarly, corners on respective sides of each trimmed edge 11*a* left in the lateral wall 11 by the formation of the respective cutout 7*a* are rounded slightly. Likewise, each of the joints between the front wall 9 and the backturned flange 10 and between the base 12 and the lateral wall 11 is correspondingly rounded.

In the construction described above, a relatively narrow gap between the inner wall 8 and the partition wall 15 constitutes an inlet line for the high frequency electromagnetic waves, and the width thereof increases, as it passes beyond the free side edge 15*a* of the partition wall 15, to a value equal to the width between the inner wall 8 and the lateral wall 11. It is to be noted that the free side edge 15*a* of the partition wall 15 terminates flush with one of the four sides of the shape of each rectangular opening 13 which is farthest from the outer wall 10 and opposite to the side edge 13*a*.

As best shown in FIG. 3, the door assembly in practice has a generally rectangular transparent covering 17 fitted to the metal plate 6 at a location on one side of the metal plate 6 opposite to the oven-defining enclosure, and also has an elastic liner 16 made of synthetic resin and fitted to the metal plate 6 so as to cover the gap between the inner wall 8 and the partition wall 15 overlaying the rear wall 14.

The liner 16 has a plurality of pawls 16*a* formed integrally therewith and is fitted to the metal plate 6 with the pawls 16*a* engaged into the rectangular openings 13 that are formed in the outer periphery of the choke groove. The liner 16 also has an extending part 16*b* formed integrally therewith so as to project in a direction opposite to the pawls 16*a*, which extending part 16*b* is engaged substantially in a shakehand fashion with a mating extension part 18 integrally formed with the transparent front covering 17 so as to protrude towards the oven-defining enclosure, thereby permitting the liner 16 to be securely held by the metal plate 6.

As hereinbefore described, since the slitted structure 7 is positioned and mounted on the metal plate 6 with the generally right-angled joint between the base 12 and the lateral wall 11 abutting against the generally right-angled joint between the front wall 9 and the outer wall 10, the slitted structure 7 can be high precisely positioned relative to the metal plate 6 when they are connected together by welding or any other connecting method. Moreover, since the free edge of the outer wall 10 and both of the trimmed edges 11*a* and the side edges 13*a* are flush with each other, it is easy to avoid any possible flotation of the slitted structure during the welding or any other connecting process.

Furthermore, because of the rounding at the joint between the base 12 and the lateral wall 11, and because of the base 12 is continuous with the lateral wall 11, the strength against the bending at the joint is high. Particularly, because the outer wall 10 overlaps the lateral wall 11 to form a substantially double-walled structure, any possible change in position can hardly occur even when an external force is applied in a direction outwards. It is, however, pointed out that, even though the joint between the lateral wall 11 and the base 12 is reinforced, portions of the lateral wall 11 around the rectangular openings 13 and the cutouts 7*a* may remain weak, which disadvantage is compensated for by the presence of the slight rounding formed during the machining of the slitted structure 7.

Figure 4:
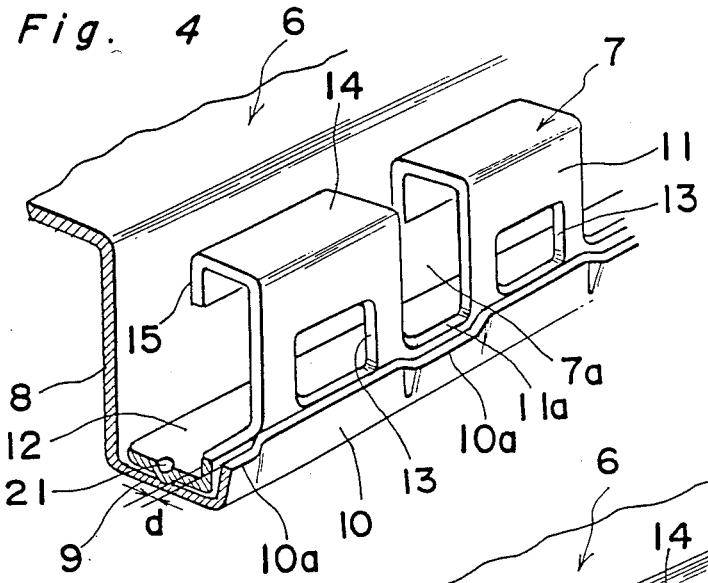
FIGS. 4 and 5 are views similar to FIG. 1, showing that portion of the door assembly according to second and third preferred embodiments of the present invention, respectively.
Figure 5:
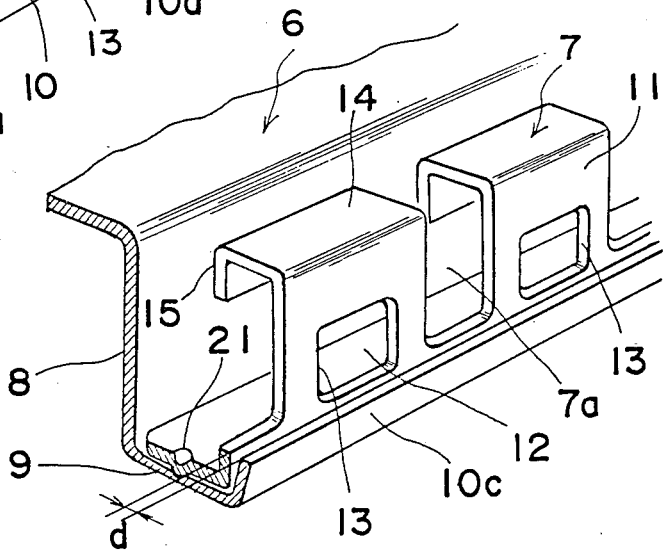

It is to be noted that it is a general practice to employ a spot welding technique to secure the slitted structure 7 to the choke groove defined by the walls 8 and 9 and outer wall 10. FIGS. 4 and 5 illustrate different methods for obviating inconveniences which may arise during spot welding. Referring to FIG. 4, a welding electrode is inserted through the cutout 7*a* and a welding is carried out between the front wall 9, which forms the bottom of the choke groove, and a point 21. If at this time the outer wall 10 is in contact with a root portion of the lateral wall 11 adjacent the joint with the base 12, a welding current will be divided at that portion with the consequence that a sufficient amount of welding current will not flow to the point 21, resulting in the insufficient welding. Accordingly, in order to avoid the division of the welding current, a slight gap d is provided between the root portion of the lateral wall 11 and that portion 10*a* of the lateral wall which aligns with each trimmed edge. As clearly shown in FIG. 4, the backturned outer wall 10 is shaped and formed to have the setback portions 10*a* spaced from the root portion of the lateral wall 11, and the remaining portions in contact with the root portion of the lateral wall 11, said setback portions 10*a* and said remaining portions alternating with each other. This is advantageous in that not only can the remaining portions of the backturned flange 10 facilitate the positioning of the slitted structure 7 relative to the choke groove, but also the substantial corrugation permits the outer wall 10 to have an increased strength.

In the example shown in FIG. 5, the backturned outer wall 10 is not corrugated as shown in FIG. 4, but a gap d is formed between the flange 10 and the root portion of the lateral wall 11 over the entire length thereof. Where the positioning of the slitted structure 7 relative to the choke groove is performed by the use of jigs and tools, the arrangement shown in FIG. 5 can advantageously be employed because it does not involve any increase in the cost and amount of material used.

Figure 6:
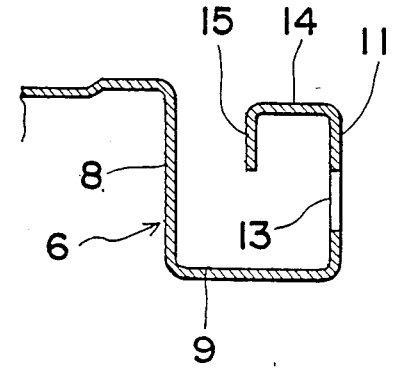
FIG. 6 is a transverse sectional view of a portion of a metal plate forming a part of the door assembly according to a fourth preferred embodiment of the present invention.
Figure 7:
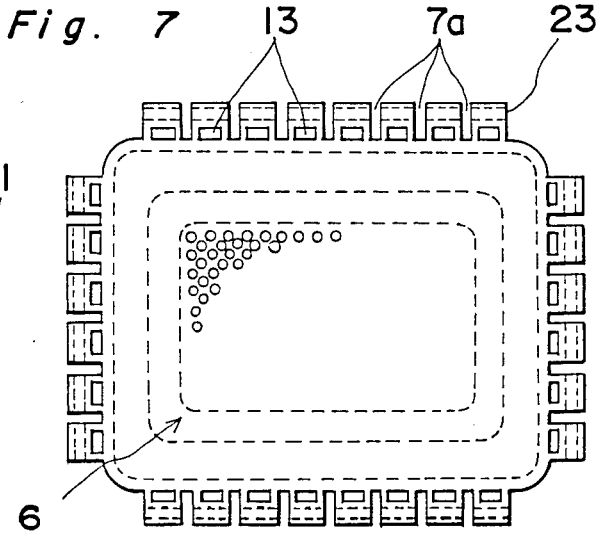
FIG. 7 is a plan view of the metal plate shown in FIG. 6 before a choke is formed.

Shown in FIGS. 6 and 7 is another embodiment of the present invention wherein the slitted structure is integrally formed with the metal plate forming the door assembly. As best shown in FIG. 6, the lateral wall 11 has one side edge continuous the rear wall 14 and an opposite side edge continuous with the front wall 9 opposite the inner wall 8. The metal plate including the slitted structure can be prepared by a metal forming or drawing technique from generally rectangular sheet metal which, as shown in FIG. 7, has a plurality of equally spaced tangs 23 integral therewith and protruding outwardly from each side of the shape of the sheet metal. Broken lines shown in FIG. 7 represent the lines of bending and, after bending and drawing the sheet metal, the space between each adjacent pair of tangs 23 constitutes the respective cutout 7*a* referred to hereinbefore in connection with the preceding embodiments. The rectangular openings 13 are formed in the tangs 23 beforehand.

The door assembly shown in FIGS. 6 and 7 is much easier to make than that in the preceding embodiments because no welding is required and moreover, the choke groove can be advantageously dimensioned precisely.

Figure 1:
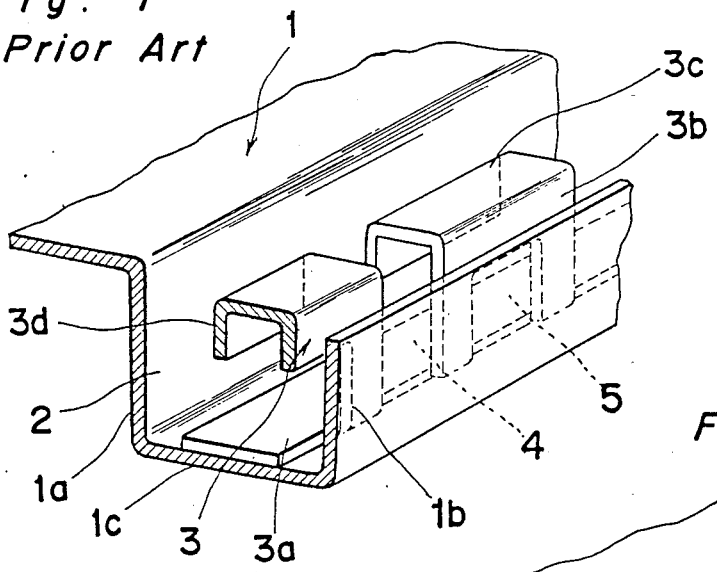
Fig. 1 Prior Art
FIG. 1 is a fragmentary perspective view of a portion of the prior art door assembly of a microwave oven.

Thus, since the choke groove can be precisely dimensioned as hereinabove described, the high frequency attenuating power can be maintained at a high value with no deviation and, moreover, the door assembly according to the present invention requires no provision of a second groove as required in the prior art door assembly described with reference to FIG. 1. Therefore, it has now become clear that not only is it possible to reduce the amount of material used to fabricate the door assembly, but also a door assembly that is compact in size and light in weight can be realized.

The depth D of the choke groove in FIGS. 2 and 3 can be smaller than a quarter wavelength of the high frequency used, according to the impedance reversion theory discussed in PCT International Publication No. WO84/01083 referred to hereinabove.

On the other hand, as discussed with particular reference to FIG. 3, the use of the liner 16 for the choke groove is essential. If the liner 16 is not used, the opening leading to the choke groove opens towards the heating chamber in the oven-defining structure, and a problem will arise that, in the event of the adherence of spilled food items, local absorption of the microwave will occur by these adhered food items resulting in a spark discharge. In view of this, the rear wall 14 of the slitted structure essentially forms between it and the front trim panel 29 around the access opening a gap of size greater than the thickness of the liner 16.

Because of the above, that portion of the microwave which leaks out of the heating chamber 19 is in part introduced into the attenuator device and in part travels straight out of the attenuator device. In order to obviate this problem, such countermeasures as will now be described with reference to FIGS. 8 and 9 are taken.

Figure 8:
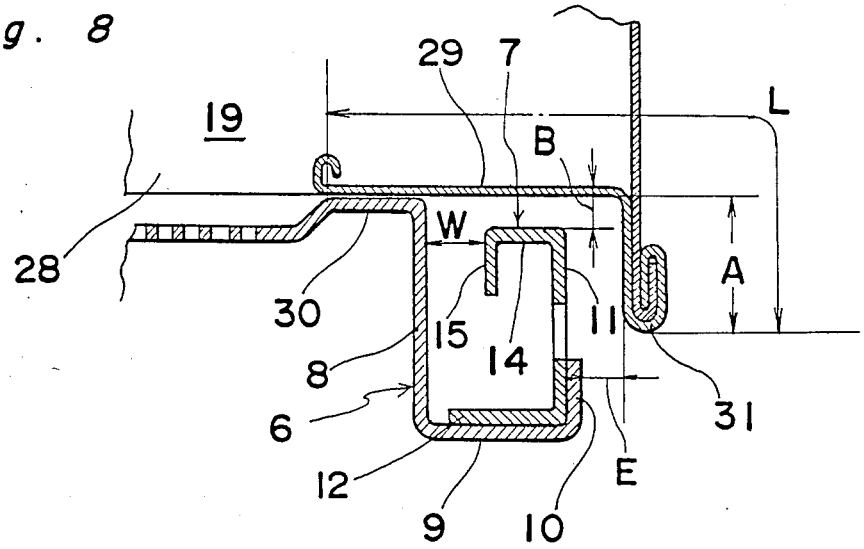
FIG. 8 is a view similar to FIG. 3, illustrating the relationships in dimensions of the portion of the door assembly.
Figure 9:
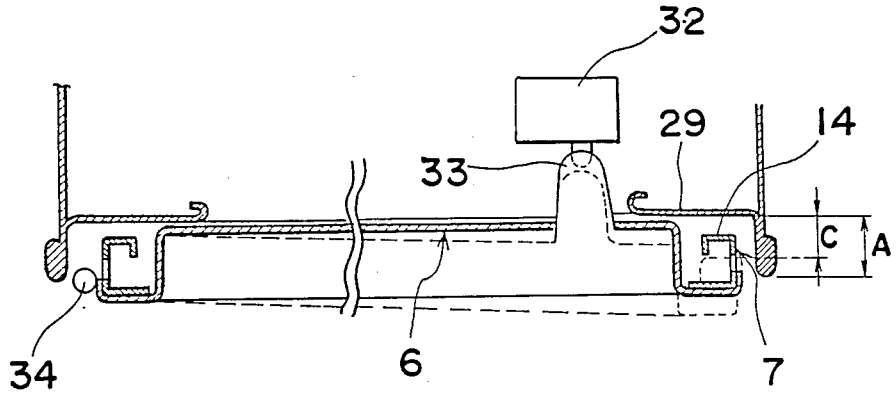
FIG. 9 is a schematic top sectional view of the door assembly showing the position of a magnetron activating switch relative to the door assembly.

Referring now to FIG. 8, there is shown the front trim panel 29 extending around the access opening 28, which panel 29 confronts the door assembly in the closed position. The metal plate 6 has a flat area 30 located between the perforated central area and the inner wall 8, which flat area 30 is spaced a distance B from the plane flush with the rear wall 14 of the slitted structure 7. The liner 16 shown in FIG. 3 has a thickness sufficient for it to be accommodated within this distance B.

The front trim panel 29 has a lateral flange 31 integral therewith and protruding frontwardly of the microwave oven so as to encircle the door assembly, when and so long as the latter is in the closed position, in uniformly spaced relation to the lateral wall 11 of the slitted structure 7, the spacing between the lateral wall 11 and the lateral flange 31 being indicated by E. In order to prevent the spacing E from being locally reduced as a result of the local deformation of the door assembly due to a structural defect, a free edge portion of the lateral flange 31 opposite to the front trim panel 29 is crimped together with a front edge of the outer casing at the front of the microwave oven accommodating the oven-defining enclosure.

It is to be noted that the distance B is preferred to be as small as possible, but must be greater than zero. A factor limiting the maximum allowable value for the distance B will be described later. That is, the flat area 30 must be spaced from the plane in which the rear wall 14 of the slitted structure 7 lies. Although the spacing represented by the distance B is essentially created by the provision of the liner 16 as hereinbefore described with reference to FIG. 3, the spacing permits a portion of the microwave, leaking outwardly between the flat area 30 and the front trim panel 29 and travelling straight without entering the choke groove, to be reflected by the lateral flange towards the inner wall 8 and then to be guided into the choke groove after having been reflected by the inner wall 8, finally attenuating. That portion of the microwave leaking outwards between the front trim panel 29 and the flat area 30 of the door assembly in part attenuates within the choke groove after having been guided thereinto through the gap between the inner wall 8 of the metal plate 6 and the partition wall 15 of the slitted structure, and in part travels towards the lateral flange 31. The leaking microwave component travelling towards the lateral flange 31 has its course of travel disturbed by the lateral flange 31, some reflected thereby and some leaking frontwardly of the microwave oven after having been deflected 90°. In other words, the path of travel of the microwave component is lengthened by the presence of barriers constituted by the metal walls upon which it reflects and, therefore, the microwave component can be greatly attenuated. Also, the microwave component reflected back by the lateral flange 31 attenuates by the interference with the microwave component travelling straight.

With respect to the relationship among the spacing E, the distance B and the width W of the high frequency inlet line, the width W must be greater than any one of the spacing E and the distance B, in order for a great portion of the microwave leaking to be introduced into the choke groove. If this relationship is reversed, the amount of the leaking microwave component travelling straight will become greater than that introduced into the choke groove and the lateral flange 31 will serve no purpose.

The width of the lateral flange 31, indicated by A, is determined as will now be described with reference to FIG. 9. A switch 32 for interrupting the oscillation of high frequency is operated by a key 33 provided on a portion of the door assembly. In general, the operating position of the switch has a predetermined range, and the switch means operated during the progressive separation of the key 33 from the switch 32 at the time the door assembly is pivoted about the hinge 34 from the closed position towards the opened position. In other words, the operating point of the switch 32 exists during the progressive separation of the key 33 from the switch 32. Considering the accuracy in positioning of the switch as well as the accuracy of the dimensions of other associated component parts, and assuming that the rear wall 14 of the slitted structure in the door assembly is, as shown by the phantom line in FIG. 9, located at a distance C from the front trim panel, the width A should be greater than the distance C while the distance C must be greater than the distance B.

In other words, the width A of the lateral flange 31 is selected so that the lateral flange 31 projects frontwardly of the microwave oven from the front trim panel 29 a distance sufficient to permit the lateral flange 31 to encircle the outer periphery of the door assembly then being pivoted from the closed position towards the opened position, before the key 33 rigid with the door assembly separates from an actuator of the switch 32 to deenergize a magnetron.

In addition, the distance L represented by the sum of the width of the front trim panel 29 and the width A of the lateral flange A is selected to be of a value equal to one quarter wavelength of the high frequency used. By so selecting the length L, an infinite impedance acts on the microwave component, which leaks outside after having travelled straight and then deflected 90°, at a position adjacent the crimped joint of the lateral flange 31, the inversion effect of which is that approximately zero impedance is attained at a position adjacent the free side of the front trim panel 29 opposite to the lateral flange 31, with the consequence that the microwave leakage is essentially minimized.

The door assembly of the construction described hereinbefore, is of a type wherein the slitted structure having both the cutouts 7*a* and the rectangular openings 13 defined in the lateral wall 14 which forms an outer wall for the metal plate 6 is mounted on the metal plate 6. Therefore, the door assembly as a whole has a strength lower than that according to the prior art and, therefore, requires countermeasures to be taken for eliminating a problem associated with warping and/or twisting without deteriorating the performance of the high frequency attenuator device.

Figure 10:
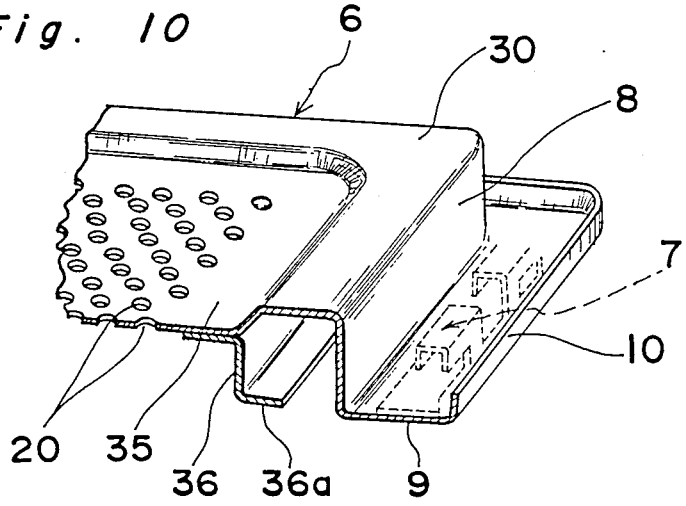
FIG. 10 is a perspective view of one corner portion of the door assembly, showing the employment of a reinforcement plate in the door assembly according to the present invention.

FIG. 10 illustrates, therefore, one method to increase the strength of the door assembly as a whole.

The fact that the outer wall 10 protrudes a small distance form the front wall 9 as hereinbefore described constitutes a major cause of reduction in strength of the door assembly as a whole. On the other hand, in terms of the capability of attenuating the microwave, the width of the outer wall 10, that is, the distance over which it protrudes transversely from the front wall 9, cannot be selected to be of a greater value than necessary.

While the strength of the door assembly as a whole is somewhat increased because of the presence of a step between the perforated central area 35 and the flat area 30 which, when the door assembly is in the closed position, contacts the front trim panel 29, a generally rectangular reinforcing plate 36 having an opening is secured by, for example, welding to the central area 35 with the opening aligned with the multiplicity of the perforations 20. This reinforcing plate 36 has a flange 36*a* integral therewith and protruding perpendicular to the plate 36 in a direction close towards the inner wall 8, said flange 36*a* being held generally flush with the front wall 9.

The door assembly of the construction as hereinbefore detailed has the following advantages.

(1) Since a periodic structure having the cutouts and the rectangular openings alternating with each other is employed as an outer wall defining the choke groove and, at the same time, a continuous portion is provided at a root portion thereof, the dimensions and positions of various parts of the groove are accurately maintained with no possibility of the high frequency attenuating performance being reduced as a result of the machining accuracy, making it possible to manufacture the door assembly light-weight and compact.

(2) In the case where the slitted structure having the cutouts and the rectangular opening is formed from a member separate from the door assembly and is secured by spot-welding or any other method to the metal plate of the door assembly, any possible occurrence of welding defects avoided by providing a small gap between the outer peripheral face of the slitted structure and the outer wall of the choke groove and, therefore, no high frequency attenuating performance will be reduced.

(3) By the provision of the metallic lateral flange laterally of the front trim panel so as to encircle the door assembly, in particular, the high frequency attenuating portion of the door assembly, an obstruction is provided to the path of travel of that portion of the microwave which has not been introduced into the high frequency attenuating portion, with the result that the attenuating performance increased. Moreover, by selecting the width of the metallic lateral flange in reference to the operating point of the switch for stopping the high frequency generator, the leakage of the microwave which would occur during the initial stage of opening of the door assembly is also avoided.

(4) By the provision of the reinforcing plate to the door assembly at such a location where the high frequency attenuating device will not be adversely affected, any possible reduction in strength resulting from the decreased width of the outermost wall of the choke groove prevented.

(5) Since there is provided a step having a predetermined size between the flat area of the metal plate exterior around the perforated area thereof and the rear wall of the slitted structure, the leaking microwave component which travels straight and is subsequently reflected by the lateral flange is easily guided into the choke groove.

(6) By selecting the sum of the width of the front trim panel and that of the lateral flange to be equal to one quarter wavelength of the high frequency used, the microwave component leaking exteriorly is further reduced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A heating apparatus employing high frequency electromagnetic wave energy, said apparatus comprising:

a heating chamber in which the high frequency electromagnetic wave energy is employed for heating, said heating chamber having an access opening and a front panel extending around said access opening;

a door hinged to said heating chamber for opening and closing over said access opening, said door having a peripheral portion surrounding said access opening when said door is closed, said peripheral portion defining a groove open towards the front panel of said heating chamber, the peripheral portion of the door comprising an outer peripheral wall defining a side of the groove, the outer peripheral wall having a plurality of projections extending toward the front panel and a plurality of openings therein, and said peripheral portion also comprising a first covering member comprised of synthetic resin extending over said projections for covering said groove, said first covering member having a plurality of engagement portions extending in said openings in said outer peripheral wall and also having an extending part, said door also comprising a second covering member defining the front face of the door, said second covering member having an extension part engaging the extending part of said first covering member for securing said first covering member to the door.

* * * * *